United States Patent [19]

Jagodzinski et al.

[11] 4,347,008

[45] Aug. 31, 1982

[54] ANTI-REVERSAL BACKCHECK FOR PRINTER RIBBON CARTRIDGE TAKEUP SPOOL

[75] Inventors: Peter F. Jagodzinski; Thomas R. Field; Carl D. Patrick, all of Lexington, Ky.

[73] Assignee: International Business Machines Corporation, Armonk, N.Y.

[21] Appl. No.: 163,656

[22] Filed: Jun. 27, 1980

[51] Int. Cl.[3] ..... B41J 35/28

[52] U.S. Cl. ..... 400/208; 400/242; 400/234; 400/231

[58] Field of Search ..... 400/208, 208.1, 234, 400/242, 196, 577, 569, 618, 207, 236.1, 236, 231

[56] References Cited

U.S. PATENT DOCUMENTS

| | | | |
|---|---|---|---|
| 774,686 | 11/1904 | Miller | 101/84 |
| 1,595,463 | 8/1926 | Going | 400/577 |
| 3,409,113 | 11/1968 | McLean | 400/234 |
| 4,024,005 | 5/1977 | Jenkins | 101/292 |

FOREIGN PATENT DOCUMENTS

| | | | |
|---|---|---|---|
| 2321651 | 4/1973 | Fed. Rep. of Germany | 400/208 |

OTHER PUBLICATIONS

IBM Technical Disclosure Bulletin, vol. 20, No. 5, Oct. 1977, Rotatable Drive Coupling For a Takeup Spool, Kirskey.

*Primary Examiner*—Edgar S. Burr
*Assistant Examiner*—Charles Pearson
*Attorney, Agent, or Firm*—Laurence R. Letson

[57] ABSTRACT

In a typewriter ribbon cartridge, it is necessary to maintain tension on the span of ribbon extending outside the cartridge to prevent tangling and to insure high print quality during machine operation. One technique for insuring that adequate tension is maintained is disclosed herein as an anti-backup back check device. Connected to the takeup spool of the ribbon cartridge is a disc member supporting thereon a pair of thin flexible resilient arms with outwardly oriented pointed ends. These ends formed in the shape of points engage ratchet teeth formed around the interior surface of a cylinder. The cylinder is formed as a part of the ribbon cartridge and, thus, is permanently positioned and fixed with respect to it. As the takeup spool disc and arms are rotated by the ribbon feed mechanism, the arms will flex and permit a rotation of the disc and takeup spool with a minimal drag force. Upon reversal, the points on the ends of the arms engage the ratchet teeth and the arms become compression columns resisting the rotation of the disc and spool. The center of the disc and the takeup spool are free floating within reasonable physical constraints. The teeth of the arms are positioned such that they are one-half tooth pitch out of phase to insure that one tooth is always in engagement with a tip of one of the two pawls.

3 Claims, 4 Drawing Figures

ANTI-REVERSAL BACKCHECK FOR PRINTER RIBBON CARTRIDGE TAKEUP SPOOL

BACKGROUND OF THE INVENTION

This invention relates to the field of printer ribbons and more particularly to printer ribbons supplied within cartridges for ease in handling. The self-containing nature of a cartridge lends itself to holding a ribbon supply spool and takeup spool with an exposed span of ribbon. When the ribbon is exposed, there is a tendency for the ribbon to sag and become slack, thus creating kinks, folds, tangles and other undesirable problems in the cartridges. Much work has been done to provide means of tensioning the ribbon and to provide a suitable tension on the externally exposed span through the use of spring wires, shock wires and other similar devices, including supply spool drag including devices such as found in U.S. Pat. No. 4,147,439. These devices function quite adequately so long as the cartridge is attached to the drive mechanism and the takeup spool is incapable of reverse rotation.

With the advent of colored ribbons, correctable ribbons and ribbons for use on permanent type documents, such as negotiable instruments and legal documents, there is a need to switch from one type of ribbon to another during the useage of a film ribbon contained in a particular cartridge. As a result, the takeup spool is disconnected from the typewriter ribbon drive mechanism and, thus, becomes subject to reverse rotation due to ribbon tension and the resulting increased slack in the exposed ribbon span. When the slack is taken up, there is an increased risk of folds or other discontinuity on the takeup spool that will create additional problems during continued usage of the cartridge, such as retyping on ribbon previously used.

A particular problem with frictional drags on the takeup spool is that the ribbon feed mechanism must, through sheer force, overcome the full drag forces applied to the takeup spool as a brake. Drag brakes are only partially effective to prevent unspooling of the used ribbon.

OBJECTS OF THE INVENTION

It is an object of the invention to provide a nonreversal backcheck mechanism for the takeup spool of a ribbon cartridge to assist in maintaining ribbon tension.

It is another object of this invention to maintain the tension of a ribbon dispensed from and contained in a ribbon cartridge.

It is a further object of this invention to provide rotation of the takeup spool only in one direction.

It is an additional object of this invention to prevent reverse movement of the takeup spool while minimizing the forces required for driving the takeup spool in its forward direction.

DRAWINGS

Figure 1:
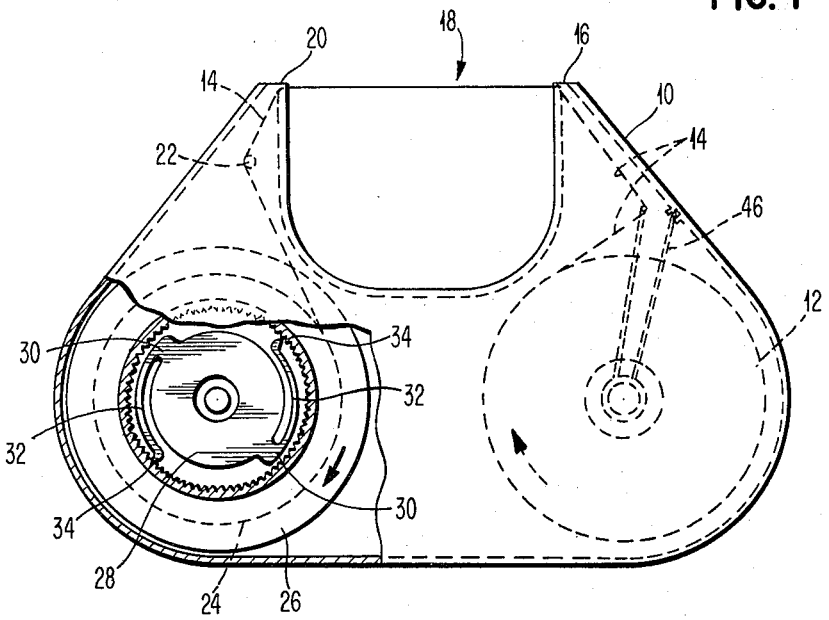
FIG. 1 illustrates a cartridge containing the anti-backup device for preventing unspooling of used ribbon.

The shortcomings of the prior art tensioning schemes are overcome and the objects of the invention are accomplished by a member supporting two flexible pawl arms thereon with the tip ends formed as points. The disc or member supporting the arms is rotationally supported within a cylindrical ratchet member with ratchet teeth formed on the interior cylindrical surface thereof. This cylindrical member may be formed as a part of the overall ribbon cartridge during the molding operation or attached thereto by any desired conventional technique.

A better understanding of the invention may be had by referring to the drawing and the more detailed description to follow.

DETAILED DESCRIPTION OF THE INVENTION

Figure 2:
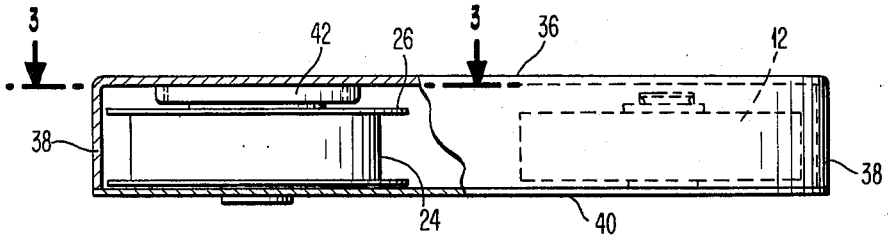
FIG. 2 illustrates an edge view of the cartridge partially broken away to reveal the takeup spool and the position of the anti-backup device with respect thereto.

Referring to FIG. 1, a ribbon cartridge 10 contains a supply spool and disc of ribbon 12. Leading from supply spool 12 is ribbon strand 14 which exits the ribbon cartridge at exit point 16. Ribbon span 18 extends from the exit point 16 to reentry point 20. Ribbon span 18 is positionable in front of a printing element and, therefore, can be impacted by the printing element of a printer or typewriter. Ribbon strand 14, after reentry into the cartridge chamber, passes about guide post 22 and then is wrapped or coiled onto the used ribbon disc 24 contained on takeup spool 26. Takeup spool 26 is attached to a disc member 28 by any conventional means but, preferably, by being molded as a single unitary piece. Takeup spool 26 may be constructed in any conventional manner as either a single molded article or an article molded in parts and assembled. Extending outwardly from the periphery of disc member 28 are support webs 30 which, in turn, support flexible arms 32 which have their terminal ends formed outwardly from the disc 28 into points 34. Cartridge 10, as is conventional with ribbon cartridges, is comprised of a top 36, bottom 40 and side wall 38 members forming a cavity. Top wall member 36 is joined to side wall members 38. This may be conveniently accomplished by molding the item as a shell in that configuration. Bottom wall member 40 is attachable to the side walls 38 to complete the cartridge 10 and form the cavity contained therein. Either formed as a part of or attached to top wall 36 is a cylindrical member 42 containing on its interior a plurality of ratchet teeth 44. The attachment of member 42 to the top wall 36 is most clearly visible in FIG. 2. The interior construction of the cylindrical member 42 and paticularly teeth 44 are most clearly visible in FIG. 3. The angle of the ratchet teeth 44 will be dependent upon the configuration of tip 34 and the line of force exerted by tip 34 to prevent camming out of the pawl tip 34.

Figure 3:
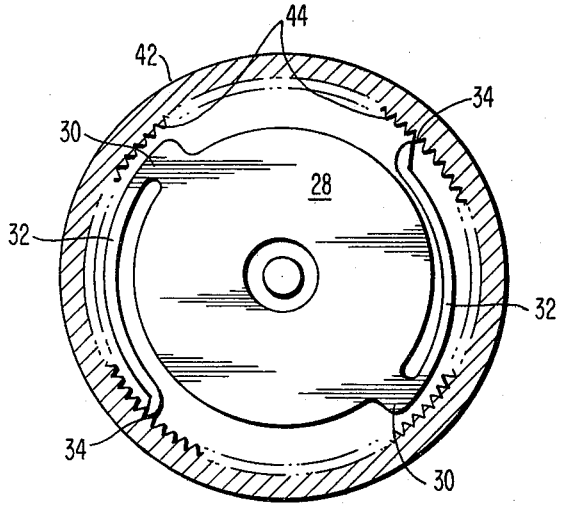
FIG. 3 illustrates an enlarged view of the anti-backup device removed from the cartridge and takeup spool.
Figure 4:
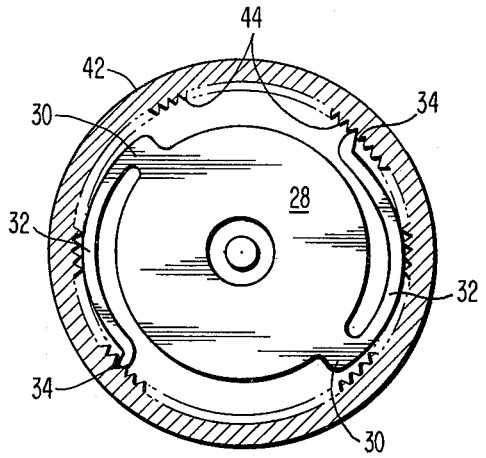
FIG. 4 illustrates an enlarged view of the anti-backup device removed from the cartridge and the takeup spool, with the arms flexed into confined contact with the ratchet teeth.

Referring to FIG. 3, disc 28 supports webs 30 which, in turn, support the flexible arms 32. Flexible arms 32 are molded as a part of or fabricated as a part of disc 28. The formation of the arms 32 are such that they have a tendency to flex outward from the axis of rotation of disc 28, thus insuring that the ends or pawl points 34 will be resiliently urged into ratchet teeth 44. The formation of the tips or points 34 are such that they will readily and easily ratchet up out of the teeth 44 when disc 28 revolves clockwise. The configuration is also such that the reverse rotation of disc 28 will act to force the pawl teeth into ratchet teeth 44 and prevent them from camming out. The arms 32, being flexible, will tend to bow outwardly upon reverse rotation of disc 28. As the arms bow outwardly, they will be constrained by ratchet teeth 44 to limit buckling and prevent breaking displacement of arms 32.

As the arms bow outwardly, they become more rigid upon engaging teeth 44. Once the arms 32 have been bowed and come into contact with teeth 44, the added support effectively causes them to become a rigid column and prevents any further reverse rotation of disc 28.

The dimension of the length of the arms 32 or positioning on disc 28 is such that one of the teeth is positioned one-half tooth width out of phase from the other pawl tip such that the pawls will alternatively engage a ratchet teeth 44. FIG. 3 illustrates one pawl tooth fully engaged with the ratchet tooth 44 while the other pawl tooth is resting on the top of a tooth 44. This further acts to reduce the possibility of inadvertent reverse rotation. Additional arms could be used with a proportionate out of phase relation between tips 34.

A further desirable feature of this arrangement is that the disc 28 is not physically constrained by the cartridge, except by the action of arms 32 and pawl tips 34. There is no shaft which will engage the disc 28 and, therefore, within some small movement, the disc 28 and attached takeup spool 26 may be translated within the cartridge to accommodate a shaft on the ribbon feed mechanism or to align itself with a correction tape cartridge which may be used in conjunction with this type of cartridge.

This device prevents the reverse rotation of disc 28 and the ribbon spool 26 attached thereto regardless of whether it is mechanically attempted to be driven in a reverse direction or whether there is an attempt to withdraw ribbon. The shock spring 46, as shown in FIG. 1, is positioned within the cartridge and is a partial wrap around the core of supply spool 12. The shock spring 46 is comprised of two arms, one attached to the cartridge 10 and the other having the ribbon strand 14 passed there around. As ribbon is pulled onto the takeup spool or is pulled out by engaging span 18, the free arm of spring 46 will move in response to that and act as the releasing clutch to allow the supply spool 12 to rotate to accommodate this feed. Under normal conditions, the arms engaging ribbon 14 of spring 46 will flex into a position tensioning ribbon 14 and span 18, thus keeping span 18 reasonably taut.

We claim:

1. A ribbon cartridge for containing and supporting a printing ribbon comprising, a cavity having at least a top and bottom surface, a supply spool mounted within said cavity and comprising a core and a coiled supply of ribbon, a take-up spool rotationally mounted within said cavity for accumulating ribbon dispensed from said supply spool, said cavity further comprising aperture means for permitting the passage of said ribbon exteriorally of said cavity, said ribbon attached to said take-up spool, said take-up spool further comprising outwardly extending arms proximate to one end of said takeup spool, said arms extending substantially concentric with said take-up spool, and said cavity further comprising a truncated cylindrical surface in one of said top or bottom surfaces, said cylindrical surface being further provided with ratchet teeth about the interior of said cylindrical surface;

said arms of said take-up spool engageable with said ratchet teeth to provide resistance to rotation of said take-up spool in a selected direction of rotation substantially in excess of any resistance to the rotation of said take-up spool in the opposite direction of rotation, said arms being flexible and positioned within and confined by said truncated cylindrical surface and said ratchet teeth thereon, to increase the effective rigidity of said arms in response to attempted rotation in said selected direction of said takeup spool, said ratchet teeth serving as means to limit the bowing of said arms through confined contact between said arms and said ratchet teeth.

2. The ribbon cartridge of claim 1 wherein said arms terminate in ends formed as a pawl and engageable with said ratchet teeth.

3. The ribbon cartridge of claim 2 wherein said pawl is substantially radial to said spool and said teeth are oriented to prevent camming of said pawl out of said teeth when forced in said selected direction.

* * * * *